US007452422B2

(12) United States Patent
Kwon et al.

(10) Patent No.: US 7,452,422 B2
(45) Date of Patent: Nov. 18, 2008

(54) APPARATUS FOR COATING PHOTORESIST HAVING SLIT NOZZLE

(75) Inventors: O-Jun Kwon, Gyeongsangbuk-Do (KR); Jeong-Kweon Park, Gyeongsangbuk-Do (KR)

(73) Assignee: LG Display Co., Ltd., Seoul (KR)

( * ) Notice: Subject to any disclaimer, the term of this patent is extended or adjusted under 35 U.S.C. 154(b) by 16 days.

(21) Appl. No.: 11/092,822

(22) Filed: Mar. 30, 2005

(65) Prior Publication Data

US 2005/0217573 A1 Oct. 6, 2005

(30) Foreign Application Priority Data

Mar. 30, 2004 (KR) ..... 10-2004-0021853

(51) Int. Cl.
*B05B 3/00* (2006.01)
*B05B 1/04* (2006.01)
*B05C 3/00* (2006.01)

(52) U.S. Cl. ..... 118/323; 118/421; 239/568

(58) Field of Classification Search ..... 118/52, 118/612, 56, 323, 300, 305, 410, 401, 407, 118/421, 429, 321; 134/198, 153; 396/604, 396/611, 627; 239/568; 427/427.3
See application file for complete search history.

(56) References Cited

U.S. PATENT DOCUMENTS

| | | | | |
|---|---|---|---|---|
| 4,949,905 | A * | 8/1990 | Jones et al. | 239/279 |
| 5,776,545 | A * | 7/1998 | Yoshiba et al. | 427/64 |
| 5,976,256 | A * | 11/1999 | Kawano | 118/684 |
| 6,692,165 | B2 * | 2/2004 | Tanaka et al. | 396/611 |

FOREIGN PATENT DOCUMENTS

| | | | |
|---|---|---|---|
| DE | 19821612 | A1 * | 11/1999 |
| JP | 05032471 | A * | 2/1993 |
| JP | 2001347211 | A * | 12/2001 |
| JP | 2004281645 | A * | 10/2004 |

OTHER PUBLICATIONS

English Translated Abstract JP 2004281645A.*
English Translated Abstract JP 2001347211A.*
English Translated Abstract of DE19821612A1.*
English translated Abstract JP-05032471.*

* cited by examiner

*Primary Examiner*—Yewebdar T Tadesse
(74) *Attorney, Agent, or Firm*—Morgan Lewis & Bockius LLP

(57) ABSTRACT

An apparatus for coating a photoresist onto a substrate includes a slit nozzle to apply the photoresist to the substrate, a slit nozzle driving unit to move the slit nozzle, and a photoresist supply unit connected to the slit nozzle to supply the photoresist to the slit nozzle.

28 Claims, 3 Drawing Sheets

APPARATUS FOR COATING PHOTORESIST HAVING SLIT NOZZLE

The present application claims the benefit of Korean Patent Application No. 21853/2004 filed in Korea on Mar. 30, 2004, which is hereby incorporated by reference.

BACKGROUND OF THE INVENTION

1. Field of the Invention

The present invention relates to an apparatus for coating a photoresist, and more particularly, to a slit coater having a slot nozzle.

2. Description of the Related Art

In a process of fabricating a liquid crystal display device or a semiconductor device, a plurality of photolithographic processes including a exposure process are performed. For the exposure process, a photoresist is applied as a photosensitive material on a substrate. The exposure process may be performed by sequential steps of coating the photoresist on a substrate or a wafer and exposing the photoresist using a mask having a predetermined pattern.

In the exposure process, a photoresist of a predetermined viscosity is applied to the substrate or the like using a coater, such as a spin coater or a spinner. However, the spin coating method using a spin coater is not suitable for applying the photoresist to a large substrate, such as a liquid crystal display panel, and also is uneconomical since an excessive amount of photoresist is consumed during spin coating.

The spin coating method uses centrifugal forces to coat the photoresist evenly. The method may comprise the steps of dropping a predetermined amount of photoresist onto a substrate loaded on a spinner, and uniformly applying the photoresist using the centrifugal force due to high-speed rotation of the spinner.

When the spinner rotates, the photoresist dropped on the spinner is uniformly coated on the substrate, but a considerable amount of photoresist is also scattered off of the spinner. Specifically, the amount of wasted photoresist is much greater than the amount of photoresist coated on the substrate. Furthermore, photoresist fragments scattered during spin coating form particles that may become an environment polluter in a clean room environment.

To solve such problems, a slit coating method using a slit type application nozzle has been proposed. The slit coating method is commonly called a spinless coater because a spinner is not used. Moreover, the slit coater is particularly suitable for applying the photoresist to a large liquid crystal display device.

The slit coater is an apparatus for coating a photoresist onto a glass substrate or the like through a line-type long slit nozzle. Here, the slit nozzle has a bar type nozzle having an ejector on a tip of the nozzle. The photoresist is ejected by the ejector on the tip of the nozzle. The slit nozzle moves from one side of the substrate to the other side, thereby uniformly applying the photoresist onto the substrate.

A general structure of a slit coater will now be described with reference to FIGS. 1 and 2. FIG. 1 is a perspective view of a slit coater according to the related art, and FIG. 2 is a sectional view of a photoresist being dropped onto a substrate by the slit coater of FIG. 1.

In FIG. 1, the slit coater in accordance with the related art includes a slit nozzle 101 for applying a photoresist to a substrate 102, a pair of nozzle driving units 103 moving the slit nozzle in one direction, and a photoresist supplying line 106. The slit nozzle 101 is a long bar-shaped nozzle and has a fine slit-shaped injector at a central portion of its lower end adjacent to the substrate 102. A certain amount of photoresist is applied through the injector.

FIG. 2 is a view showing the slit nozzle 101 and the substrate 102. In FIG. 2, the slit nozzle 101 applies the photoresist to the substrate 102 moving from one side of the substrate to the other one side at a constant speed.

The slit coater is advantageous in that the amount of photoresist discarded can be reduced since a photoresist is uniformly applied to the substrate through a fine slit. Here, to apply the photoresist to the substrate with a uniform thickness, a very fine ejector of the slit nozzle is required. For this reason, forming a fine ejector is a core technology in manufacturing a slit coater. Furthermore, to uniformly apply the photoresist onto the substrate, a photoresist supply unit should supply a high quality photoresist without bubbles or particles to the slit nozzle.

SUMMARY OF THE INVENTION

Accordingly, the present invention is directed to an apparatus for coating photoresist having slit nozzle that substantially obviates one or more of the problems due to limitations and disadvantages of the related art.

An object of the present invention is to provide a slit coater capable of uniformly applying a photoresist onto a substrate and of precisely controlling pressure of the applied photoresist.

Another object of the present invention is to provide a slit coater that supplies a uniform photoresist in manufacturing a large-sized liquid crystal display device, thereby preventing bubbles and particles from being contained in the photoresist even when a distance between a photoresist supply unit and a slot nozzle is long.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described herein, an apparatus for coating a photoresist onto a substrate comprises a slit nozzle to apply the photoresist to the substrate; a slit nozzle driving unit to move the slit nozzle; and a photoresist supply unit connected to the slit nozzle to supply the photoresist to the slit nozzle.

In another aspect, an apparatus for coating a photoresist onto a substrate comprises a slit nozzle to apply the photoresist to the substrate; a slit nozzle driving unit to support the slit nozzle and to move the slit nozzle on the substrate; a photoresist supply unit connected to the slit nozzle to provide the photoresist from the photoresist supply unit to the slit nozzle; and a support unit to support the photoresist supply unit and to separate the photoresist supply unit from the slit nozzle by a predetermined distance.

In another aspect, an apparatus for coating a photoresist onto a substrate comprises a slit nozzle to apply the photoresist to the substrate, the slit nozzle having a dispensing slit with a length greater than a width of the substrate; a slit nozzle driving unit to support the slit nozzle and to move the slit nozzle along the substrate; and a photoresist supply unit connected to the slit nozzle to supply the photoresist to the slit nozzle.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

A structure of a slit coater in accordance with the present invention will now be described with reference to FIGS. 3 to 5. Here, FIG. 3 is a perspective view of an exemplary slit coater in accordance with an embodiment of the present invention, FIG. 4 is a sectional view of the exemplary slit coater of FIG. 3, and FIG. 5 is a sectional view of an exemplary photoresist supply unit and an exemplary slit nozzle of the slit coater in accordance with the present invention.

Figure 1:
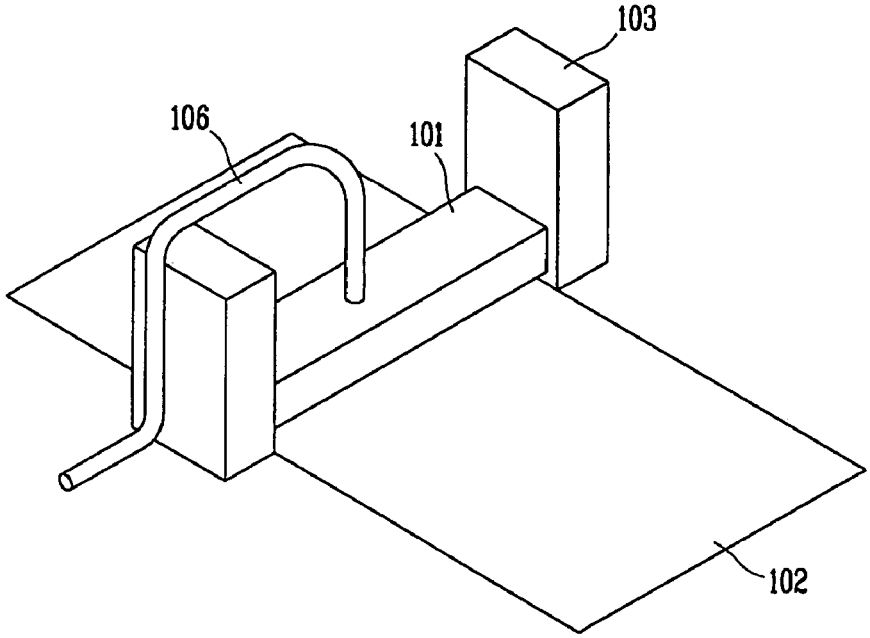
FIG. 1 RELATED ART
FIG. 1 is a perspective view of a slit coater according to the related art.
Figure 2:
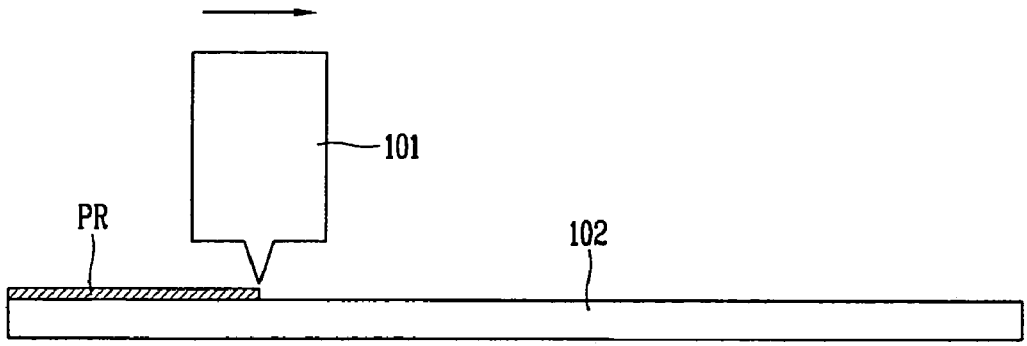
FIG. 2 RELATED ART
FIG. 2 is a sectional view of a photoresist being dropped onto a substrate by the slit coater of FIG. 1.
Figure 3:
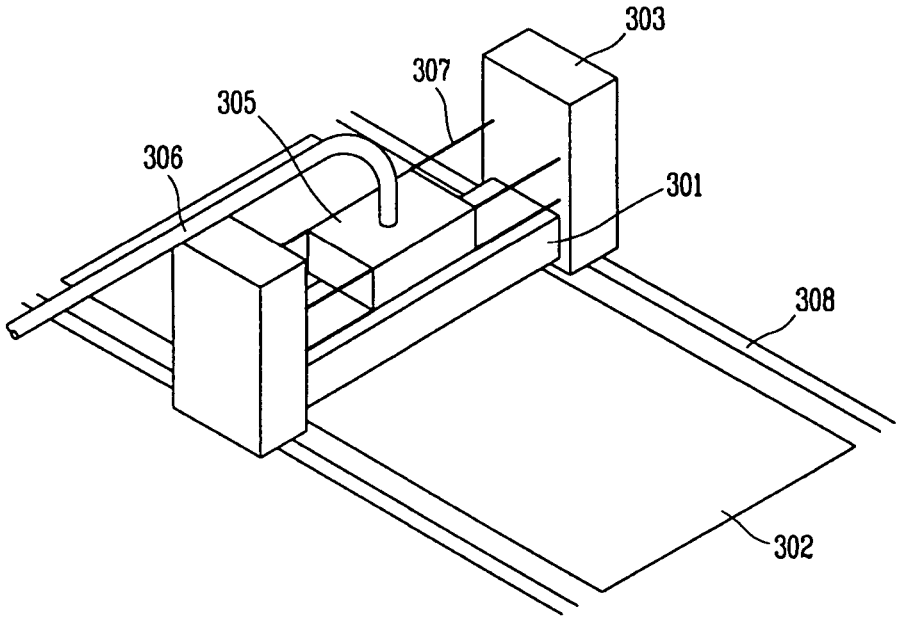
FIG. 3 is a perspective view of an exemplary slit coater in accordance with an embodiment of the present invention.
Figure 4:
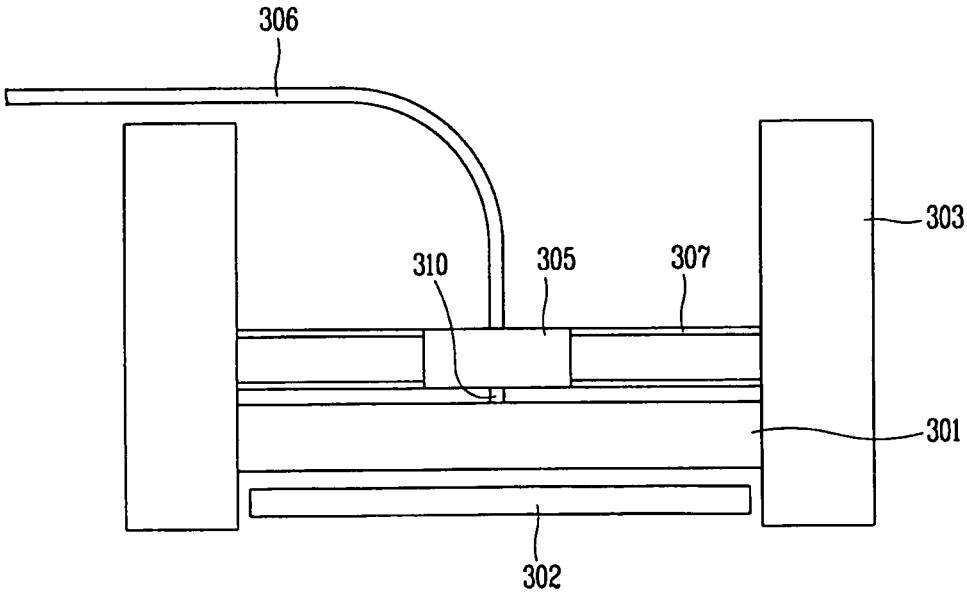
FIG. 4 is a sectional view of the exemplary slit coater of FIG. 3 in accordance with the present invention.
Figure 5:
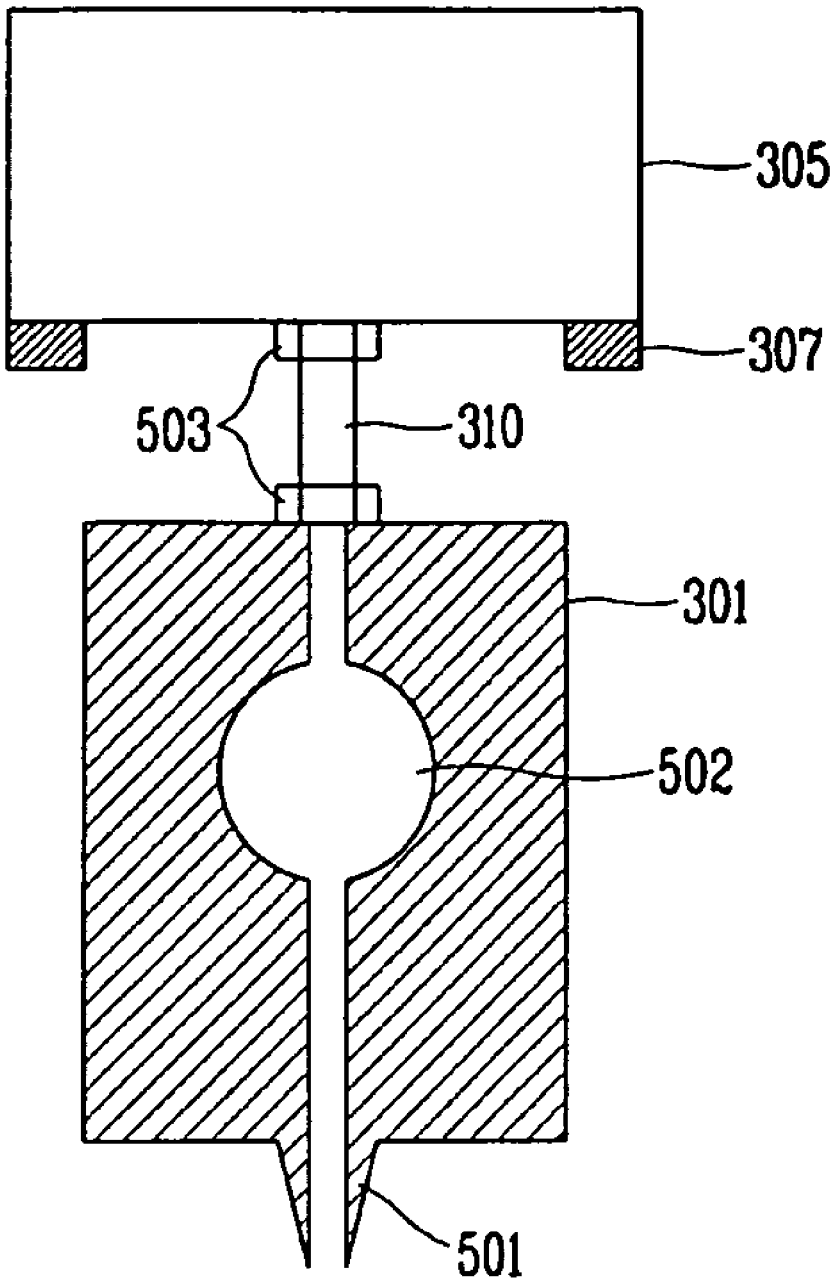
FIG. 5 is a sectional view of an exemplary photoresist supply unit and an exemplary slit nozzle of the slit coater in accordance with the present invention.

Referring to FIGS. 3 and 4, an exemplary slit coater in accordance with the present invention comprises a slit nozzle 301 provided with a slit-shaped ejector (not shown in FIG. 3) and discharging a photoresist onto a substrate 302 through the ejector. The ejector is formed as a long bar shape as two facing metallic plates separated from each other at a very small distance of a few micrometers. The photoresist is applied onto the substrate through the linear ejector at a constant density. The slit nozzle 301 may have a length that is the same as or longer than that of one side of the substrate 302 in order to span that side.

The slit nozzle 301 is connected to slit nozzle driving units 303 formed at both ends of the slit nozzle. When the slit nozzle driving units 303 move, the slit nozzle 301 also moves on the substrate 302 at a constant speed by the movement of the driving unit 303. At this time, an interval between the slit nozzle 301 and the substrate 302 can be precisely controlled with regard to the amount and viscosity of applied photoresist. In general, since drying of the photoresist begins as soon as the photoresist is applied to the substrate, the slit nozzle 301 and the substrate 302 closely approach each other within an interval of about hundreds of micrometers so that a viscosity change due to such drying may be prevented.

Meanwhile, the slit nozzle driving units 303 for moving the slit nozzle 301 is constructed as a pair respectively disposed at both ends of the slit nozzles 301, wherein the slit nozzle driving units 303 support the slit nozzle 301. In this manner, the slit nozzle 301 is moved across the substrate 302. Here, the slit nozzle driving unit 303 may have a linear motor (not shown) at a lower end of the slit nozzle driving unit 303 that may be connected to a linear rail 308 formed parallel to, but outside of, the substrate 302 to move along the linear rail.

Also, the photoresist supply unit 305 for supplying the photoresist to the slit nozzle 301 may be formed adjacently above the slit nozzle 302. Also, the photoresist supply unit 305 may be fixed by a support unit 307 having a bar shape, and may be connected to the slit nozzle driving unit 303 and support the photoresist supply unit 305 while separating the supply unit 305 from the slit nozzle 301 at the smallest possible distance. The gap between the photoresist supply unit 305 and the slit nozzle 301 therebelow may be about ten centimeters.

The photoresist supply unit 305 may be provided with a pumping unit, such as a pump or the like to eject the stored photoresist into the slit nozzle 301. When the photoresist is ejected into the slit nozzle 301, photoresist is supplied again to the photoresist supply unit from the outside in an amount equal to the ejected photoresist. Namely, ejecting and receiving of the photoresist are made in the photoresist supply unit at the same time.

The photoresist supply unit 305 is formed above the slit nozzle 301 at the shortest possible distance therebetween and is connected to the slit nozzle 301 by a connecting portion 310. Accordingly, the connecting portion 310 may be constructed as short as possible and may be constructed as a single pipe. In addition, the connecting portion 310 may be made of a flexible material to prevent vibration generated by pumping operation of the photoresist supply unit from being transmitted to the slit nozzle. Furthermore, the connecting portion 310 may work as a path through which the photoresist moves from the photoresist supply unit 305 to the slit nozzle 301.

Referring to FIG. 5, an exemplary connection between the photoresist supply unit 305 and the connection nozzle 301 will now be described in more detail. As shown therein, the photoresist supply unit 305 is formed above the slit nozzle 301 at a certain distance therebetween. The photoresist supply unit 305 and the slit nozzle 301 is connected together by the connecting portion 310 that is constructed as a pipeline or the like, and both ends of the connecting portion 310 are coupled to the photoresist supply unit 305 and to the slit nozzle 301 by coupling units 503, respectively.

To prevent occurrences of defects during application due to vibration transmitted to the slit nozzle 301 by the pumping operation of the photoresist supply unit 305, the photoresist supply unit 305 may be separated from the slit nozzle 301 by the shortest possible distance therebetween. In addition, the photoresist supply unit 305 may directly contact an upper portion of the slit nozzle 301 with a vibration preventing unit for the photoresist supply unit 305, such as a vibration preventing plate or a buffer, interposed between the photoresist supply unit 305 and the slit nozzle 301. If the photoresist supply unit 305 and the slit nozzle 301 are in direct contact with each other, the connection portion 310 may be unnecessary.

The slit coater in accordance with the present invention may prevent bubbles or foreign substances from flowing into the applied photoresist by minimizing a distance between the photoresist supply unit 305 and the slit nozzle 301, thereby minimizing a moving distance of the ejected photoresist. Thus, the slit coater in accordance with the present invention allows a good photoresist whose viscosity and density are constantly maintained and which contains no foreign substances to be applied to the substrate.

In FIG. 5, the slit nozzle 301 is provided with a cavity 502 for temporarily storing an injected photoresist before applying it. The cavity 502 may have a larger diameter than that of photoresist ejector 501, and may be formed having a line shape along a longitudinal direction of the slit nozzle 301. The cavity 502 temporarily stores the injected photoresist and allows the photoresist to be constantly distributed to the entire slit nozzle 301. Here, the cavity 502 discharges the photoresist by pressure of a photoresist contained in the cavity 502 and pressure of a photoresist supplied from the photoresist supply unit 305.

FIG. 4 shows a sectional view of a slit coater in accordance with the present invention. Referring to FIG. 4, the slit coater in accordance with the present invention includes a slit nozzle 301 formed as a bar shape across a substrate 302, slit nozzle driving units 303 formed at both sides of the substrate and moving the slit nozzle 301, a photoresist supply unit 305 formed above the slit nozzle at a certain distance from the slit nozzle 301, a support unit 307 having a bar shape for separating the photoresist supply unit 305 from the slit nozzle 301 at a certain distance therebetween, a connection portion 310 connecting the photoresist supply unit 305 to the slit nozzle 301 and being a path through which the photoresist moves from the photoresist supply unit 305 to the slit nozzle 301, and a photoresist supply line 306 for supplying the photoresist to the photoresist supply unit 305.

According to the present invention, the photoresist supply unit 305 may be formed on the slit nozzle 301 directly contacting with the slit nozzle. Accordingly, the photoresist may be applied nonuniformly due to the vibration of the photoresist supply unit. Thus, the photoresist supply unit 305 and the slit nozzle 301 may be directly coupled together and hermetically sealed by a gasket with a vibration preventing plate, such as a plurality of springs, a rubber pad or the like, interposed therebetween to prevent transmission of the vibration. If the photoresist supply unit 305 is directly coupled to the slit nozzle, the connection portion 310 and the photoresist supply unit support bar may be unnecessary.

Because the photoresist supply unit and the slit nozzle may be adjacent to each other or coupled together, air or the like can be prevented from flowing into the photoresist while the slit coater supplies the photoresist to the substrate, thereby preventing the photoresist from being ununiformly applied to the substrate. In addition, because a distance between the photoresist supply unit and the slit nozzle may be very small, the photoresist discharged from the photoresist supply unit can be uniformly applied. Accordingly, the present invention is advantageous in that the amount of discharged photoresist can be precisely controlled.

The slit coater in accordance with the present invention is particularly advantageous, but not limited to, the application of photoresist to a large substrate used for manufacturing a larger screen liquid crystal display device. In comparison with the conventional spin coating method, the amount of photoresist used can be minimized. Also, the slit coater in accordance with the present invention is particularly advantageous in that the photoresist can be applied even to a large-sized substrate which makes it difficult to apply the photoresist thereto using the spin coating method.

It will be apparent to those skilled in the art that various modifications and variations can be made in the apparatus for coating photoresist having slit nozzle of the present invention without departing from the spirit or scope of the invention. Thus, it is intended that the present invention cover the modifications and variations of this invention provided they come within the scope of the appended claims and their equivalents.

What is claimed is:

1. An apparatus for coating a photoresist onto a substrate, comprising:

a slit nozzle to apply the photoresist to the substrate;

a slit nozzle driving unit to move the slit nozzle; and a photoresist supply unit to provide photoresist to the slit nozzle from away from the slit nozzle driving unit using a photoresist supply line, wherein the photoresist supply unit integrally moves with the slit nozzle.

2. The apparatus of claim 1, wherein the photoresist supply unit is directly connected to the slit nozzle.

3. The apparatus of claim 2, wherein the photoresist supply unit and the slit nozzle are connected to each other with a vibration preventing unit interposed therebetween.

4. The apparatus of claim 1, wherein the photoresist supply unit is connected to the slit nozzle by a connection portion.

5. The apparatus of claim 4, wherein the photoresist moves from the photoresist supply unit to the slit nozzle through the connection portion.

6. The apparatus of claim 4, further comprising:

a support unit to support the photoresist supply unit, the photoresist supply unit being separated from the slit nozzle by a predetermined distance.

7. The apparatus of claim 4, wherein the photoresist supply unit is adjacent to the slit nozzle with the connection portion interposed therebetween.

8. The apparatus of claim 1, wherein the slit nozzle driving unit includes a pair of slit driving units disposed on opposing sides of the substrate.

9. The apparatus of claim 8, wherein the slit nozzle has a bar shape disposed across the substrate and supported by the pair of slit nozzle driving units.

10. The apparatus of claim 1, wherein the photoresist supply unit discharges and receives photoresist at the same time.

11. The apparatus of claim 1, wherein the slit nozzle includes a cavity to temporarily store the photoresist and a photoresist ejector to eject the photoresist, the cavity having a dimension greater than that of the photoresist ejector.

12. The apparatus of claim 11, wherein a fluid passage connecting the cavity and the photoresist supply unit has a dimension smaller than the cavity.

13. The apparatus of claim 1, wherein the photoresist supply unit receives photoresist from away from the slit nozzle driving unit using a photoresist supply line away.

14. An apparatus for coating a photoresist onto a substrate, comprising:

a slit nozzle to apply the photoresist to the substrate;

a slit nozzle driving unit to support the slit nozzle and to move the slit nozzle on the substrate;

a photoresist supply unit to provide photoresist to the slit nozzle from away from the slit nozzle driving unit using a photoresist supply line; and a support unit to support the photoresist supply unit and to separate the photoresist supply unit from the slit nozzle by a predetermined distance, wherein the photoresist supply unit integrally moves with the slit nozzle.

15. The apparatus of claim 14, wherein the slit nozzle includes a cavity to temporarily store the photoresist and a photoresist ejector to eject the photoresist, the cavity having a dimension greater than that of the photoresist ejector.

16. The apparatus of claim 15, wherein a fluid passage connecting the cavity and the photoresist supply unit has a dimension smaller than the cavity.

17. An apparatus for coating a photoresist onto a substrate, comprising:

a slit nozzle to apply the photoresist to the substrate, the slit nozzle having a dispensing slit with a length greater than a width of the substrate;

a slit nozzle driving unit to support the slit nozzle and to move the slit nozzle across the substrate; and a photoresist supply unit to provide photoresist to the slit nozzle from away from the slit nozzle driving unit using a photoresist supply line, wherein the photoresist supply unit integrally moves with the slit nozzle.

18. The apparatus of claim 17, wherein the slit nozzle driving unit includes a pair of slit driving units disposed on opposing sides of the substrate.

19. The apparatus of claim 17, wherein the photoresist supply unit and the slit nozzle are connected to each other to prevent vibration from being transmitted therebetween.

20. The apparatus of claim 17, further comprising: a support unit to support the photoresist supply unit, the photoresist supply unit being separated from the slit nozzle by a predetermined distance.

21. The apparatus of claim 17, wherein the slit nozzle includes a cavity to temporarily store the photoresist and a photoresist ejector to eject the photoresist, the cavity having a dimension greater than that of the photoresist ejector.

22. The apparatus of claim 21, wherein a fluid passage connecting the cavity and the photoresist supply unit has a dimension smaller than the cavity.

23. The apparatus of claim 17, wherein the photoresist supply unit receives photoresist from away from the slit nozzle driving unit using a photoresist supply line.

24. An apparatus for coating a photoresist onto a substrate, comprising:

a slit nozzle to apply the photoresist to the substrate;

a slit nozzle driving unit to support the slit nozzle and to move the slit nozzle on the substrate;

a photoresist supply unit to provide photoresist to the slit nozzle from away from the slit nozzle driving unit using a photoresist supply line; and a support unit to support the photoresist supply unit and to separate the photoresist supply unit from the slit nozzle by a predetermined distance, wherein the photoresist supply unit integrally moves with the slit nozzle.

25. The apparatus of claim 24, wherein the photoresist supply unit prevents vibration from being transmitted to the slit nozzle.

26. The apparatus of claim 24, wherein the photoresist supply unit is formed on the slit nozzle and is connected to the slit nozzle by a flexible connection portion so that vibration of the photoresist supply unit is prevented from being transmitted to the slit nozzle.

27. The apparatus of claim 26, wherein the photoresist moves from the photoresist supply unit to the slit nozzle through the connection portion.

28. The apparatus of claim 24, wherein the slit nozzle driving unit includes a pair of slit driving units disposed on opposing sides of the substrate.

* * * * *